US008640683B2

(12) United States Patent
Meggs et al.

(10) Patent No.: US 8,640,683 B2
(45) **Date of Patent: *Feb. 4, 2014**

(54) SOFT-PROJECTILE LAUNCHING DEVICE

(71) Applicant: The Maya Group, Inc., Torrance, CA (US)

(72) Inventors: Keith G. Meggs, Rancho Palos Verdes, CA (US); Ronald Brawer, Manhattan Beach, CA (US); Michael G. Hoeting, Cincinnati, OH (US); Neil Hamilton, Covington, KY (US)

(73) Assignee: The Maya Group, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/761,082

(22) Filed: Feb. 6, 2013

(65) Prior Publication Data

US 2013/0247891 A1 Sep. 26, 2013

Related U.S. Application Data

(62) Division of application No. 12/777,134, filed on May 10, 2010, now Pat. No. 8,371,282.

(51) Int. Cl.
*F41B 11/00* (2013.01)

(52) U.S. Cl.
USPC ..... 124/56; 124/45

(58) Field of Classification Search
USPC ..... 124/1, 17, 63, 79, 16, 56, 45, 65
See application file for complete search history.

(56) References Cited

U.S. PATENT DOCUMENTS

| | | | | |
|---|---|---|---|---|
| 71,162 | A | 11/1867 | Hall | |
| 1,202,227 | A * | 10/1916 | Sandifur | 474/81 |
| 3,408,997 | A | 11/1968 | Ruymbecke | |
| 3,472,218 | A | 10/1969 | La Mers | |
| 3,631,555 | A | 1/1972 | Hurst et al. | |
| 3,648,561 | A * | 3/1972 | Stoner | 89/11 |
| 4,834,059 | A | 5/1989 | Moorhouse et al. | |
| 5,285,765 | A | 2/1994 | Lee | |
| 5,622,159 | A | 4/1997 | Liu et al. | |
| 5,697,179 | A | 12/1997 | Vanmoor | |
| 5,885,912 | A * | 3/1999 | Bumbarger | 442/239 |
| 6,386,293 | B1 | 5/2002 | Bartlett | |
| 7,004,813 | B2 | 2/2006 | Zuloff | |
| 7,992,647 | B2 * | 8/2011 | Cordani | 169/30 |

(Continued)

FOREIGN PATENT DOCUMENTS

| | | |
|---|---|---|
| EP | 2253375 A1 | 11/2010 |
| GB | 316645 | 1/1972 |

OTHER PUBLICATIONS

International Search Report and Written Opinion for Corresponding PCT Application No. PCT/US2011/066307 dated Apr. 24, 2012.

(Continued)

*Primary Examiner* — Michael David
(74) *Attorney, Agent, or Firm* — Dickstein Shapiro LLP

(57) ABSTRACT

A device for projecting a soft-projectile made from a super absorbent polymer, the device comprising a holder designed for containing the soft-projectile made from a super absorbent polymer; and a firing mechanism operatively arranged to accelerate the holder from a firing position.

15 Claims, 3 Drawing Sheets

(56) References Cited

U.S. PATENT DOCUMENTS

| | | | | |
|---|---|---|---|---|
| 8,371,282 | B2 * | 2/2013 | Meggs et al. | 124/56 |
| 2004/0104533 | A1 * | 6/2004 | Larson et al. | 273/404 |
| 2004/0212151 | A1 * | 10/2004 | Peiten et al. | 273/404 |
| 2009/0145412 | A1 | 6/2009 | Barish | |
| 2010/0059237 | A1 * | 3/2010 | Cordani | 169/54 |
| 2011/0271940 | A1 * | 11/2011 | Meggs et al. | 124/56 |
| 2011/0271941 | A1 * | 11/2011 | Meggs | 124/65 |
| 2011/0290103 | A1 * | 12/2011 | Herrmann et al. | 89/18 |
| 2012/0152221 | A1 * | 6/2012 | Meggs | 124/41.1 |

OTHER PUBLICATIONS

International Search Report and Written Opinion for Corresponding PCT Application No. PCT/US2011/035801 dated Oct. 19, 2011.

* cited by examiner

SOFT-PROJECTILE LAUNCHING DEVICE

CROSS-REFERENCE TO RELATED APPLICATION

This application is a divisional and claims the benefit of U.S. patent application Ser. No. 12/777,134, filed May 10, 2010, which is hereby incorporated by reference.

FIELD

The present patent document relates to soft-projectile launching devices, such as projectile toys. More particularly, the present patent document relates to soft-projectile launching devices that launch super absorbent polymer projectiles and related devices and methods.

BACKGROUND

Children have a variety of different types of projectile launching toys available to them. For example, HASBRO® makes an entire line of NERF® weaponry that fire NERF® projectiles. NERF® is a trademarked term well known in the toy industry and is associated with soft foam-like material. Other than weaponry, NERF® is also commonly associated with sports balls such as footballs, basketballs, and others. Over the years, a large number of NERF® foam-based weaponry products have been developed, including various blasters that launch various types of NERF® projectiles including darts, rockets, and balls.

NERF® foam is a spongy cellular material produced by the reaction of polyester with a diisocyanate. The polyester resin reacts with the diisocyanate while $CO_2$ is simultaneously released by another reaction. The $CO_2$ gas creates open pockets within the polyurethane that give the NERF® foam its soft and light properties.

One reason the NERF® foam and other foam based projectile toys have became so popular has been due to the soft and light properties of the foam material. For example, NERF® balls were originally marketed as the "world's first official indoor ball." These same soft and light properties also make NERF® and other foams a great material for projectiles. Projectiles made from NERF® and other similar foams can be formed into balls and darts and fired from toy weaponry with little risk of injury. To this end, HASBRO® and other toy manufacturers have created numerous toy weaponry lines that shoot foam based projectiles including the N-Strike® line of toys.

Although NERF® and other foam like materials can be used to make toy weaponry projectiles that are relatively safe to project or launch, the properties of NERF® and other foam like materials have some significant drawbacks when used as projectiles for projectile launching toys. Because foam based materials such as NERF® foam are light, they are highly susceptible to air forces when trying to project them through the air in free flight as occurs when fired from toy weaponry. The soft, light properties of foam and NERF® type products are due to their low density. The low density of foam based projectiles decreases the momentum of the projectiles, which in turn increases the effect of air resistance, drag, and other motion retarding forces. This causes foam based projectiles to rapidly slow after initial firing and easily curve off line.

There are also small projectile systems for gaming and professional training purposes. These include paint ball guns and airsoft guns, but these systems are for adult use only due to the energy imparted to the projectile and the ability of the projectile to do serious harm.

SUMMARY OF THE INVENTION

One object of the present patent document is to provide an alternative soft-projectile launching system to those presently on the market. To this end, in one embodiment, a projectile launching device is provided that launches projectiles made from super absorbent polymers. The projectile launching device comprises: a holder designed for containing the soft-projectile made from a super absorbent polymer; and a firing mechanism operatively arranged to accelerate the holder from a firing position.

In another embodiment the holder of the soft-projectile launching system is slideably contained by the device. In another embodiment, the holder for a soft-projectile translates between the firing position and a launch point for the soft-projectile. In yet another embodiment the soft-projectile launching system further comprises a barrel having an interior in communication with the firing position wherein the holder for a soft-projectile translates down the barrel such that a soft-projectile launches from the barrel with little or no contact with the interior of the barrel.

In one embodiment, the soft-projectile launching system may have a firing mechanism incapable of storing energy independent of the user. Yet in other embodiments, the launching system may store energy. The soft-projectile launching systems of the present patent document may use air pressure, springs, rubber bands or any other suitable firing mechanism to launch the soft-projectile.

In another aspect of the present patent document, ammunition for a soft-projectile projection device is provided. The ammunition according to one embodiment comprises a plurality of projectiles made from a super absorbent polymer. The projectiles may be contained in a magazine. The projectiles may be hydrated or dehydrated.

In one embodiment, the projectiles have a diameter of less than 10 millimeters when hydrated. In yet another embodiment, the projectiles have a diameter of more than about 4 mm and less than about 9 mm when hydrated.

In another aspect of the present patent document, a magazine for a device for projecting soft-projectiles is provided. The magazine according to one embodiment comprises: a container having an interior volume having at least one opening wherein the container is configured to operatively mate with a device for projecting soft-projectiles and a plurality of projectiles made from a super absorbent polymer contained within the interior volume. The projectiles in the magazine may be hydrated or dehydrated and the magazine may include an inlet opening configured to only allow dehydrated projectiles to pass through into the magazine.

In one embodiment, the magazine further comprises a locking mechanism that prevents an outlet opening from opening unless the magazine is mated with a corresponding projection device.

In yet another aspect, a method of producing soft-projectiles is provided. The method comprises the steps of: placing a plurality of pieces of a super absorbent polymer in a liquid; allowing time for the plurality of pieces of a super absorbent polymer to absorb the liquid; and placing the plurality of pieces of a super absorbent polymer in a magazine.

In yet another aspect, a kit for making a plurality of soft-projectiles from a super absorbent polymer is provided. In one embodiment, the kit comprises: a predetermined quantity of dehydrated projectiles stored in a container, the dehydrated projectiles comprising a super absorbent polymer; instructions for adding the dehydrated projectiles into a interior chamber of a magazine and hydrating the dehydrated projectiles in the interior chamber of the magazine. The container may, for example, comprise a sealed pouch or other low cost, disposable container.

In another embodiment, an adaptation mechanism for a projectile toy comprises: a soft-projectile holder adapted to hold a soft-projectile made from a super absorbent polymer; and an attachment mechanism connected to the soft-projectile holder wherein the attachment mechanism is designed to mate to a firing mechanism of the projectile toy.

The super absorbent polymer projectile launching toys and/or weaponry described herein may increase the user experience as compared to foam-based projectile toys, yet they remain safe for children to use. Further aspects, objects, desirable features, and advantages of the devices and methods disclosed herein will be better understood from the detailed description and drawings that follow in which various embodiments are illustrated by way of example. It is to be expressly understood, however, that the drawings are for the purpose of illustration only and are not intended as a definition of the limits of the claimed invention.

DETAILED DESCRIPTION OF THE PREFERRED EMBODIMENTS

Figure 1:
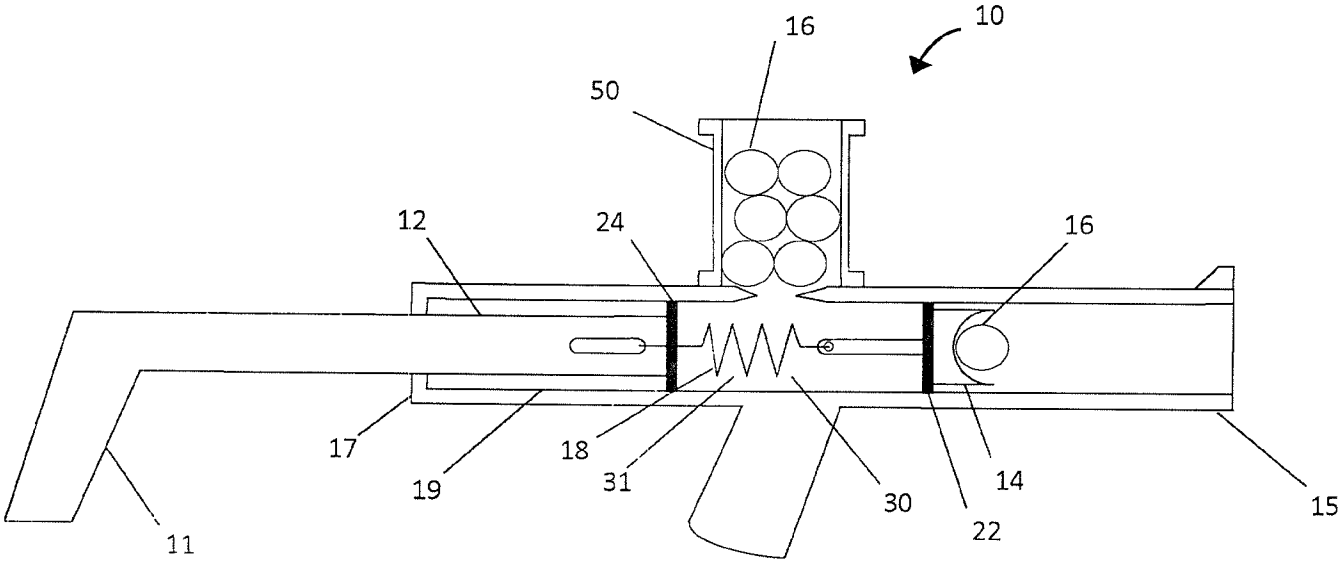
FIG. 1 illustrates a cross section of one embodiment of a projectile launching toy designed for use with a plurality of projectiles made from a super absorbent polymer.

The term "magazine" is used herein to refer to any container that holds super absorbent polymer projectiles for a projectile toy gun or other projectile weaponry. The magazine could be of any shape size or volume and have any number of openings as long as it holds super absorbent polymer projectiles in a useable manner for a corresponding super absorbent polymer projectile launching device.

Super absorbent polymers (SAP's) were first invented by the United States Department of Agriculture (USDA) in the 1960's and are commonly used in personal disposable hygiene products such as diapers, protective underwear, and sanitary napkins SAP's are polymers that can absorb an extremely large amount of liquid relative to their own mass. SAP's absorb aqueous solutions through hydrogen bonding with water molecules.

The present patent document discloses and teaches projectile launching devices, such as toys, amateur guns and weaponry that use projectiles formed from a super absorbent polymer (SAP). As a result, the projectiles launched by the devices of the present patent document are soft-projectiles. Further, once hydrated, the unique properties that SAP's exhibit give the soft-projectiles several advantages over current projectile materials such as paint balls, plastics, and foams. For example, hydrated SAP projectiles can maintain their shape under modest pressure. The ability of SAP projectiles to maintain their shape allows them to be projected with a reasonable force and velocity without breaking apart. However, under excessive pressure, hydrated SAP projectiles will break down and lose their shape. Because SAP projectiles break down under excessive pressure, the force at impact is spread over a much wider surface area, thus reducing the likelihood of injury.

SAP projectiles can also be designed to break down at different pressures based on their composition. This allows them to be tailored to have specific qualities as soft-projectiles. The total absorbency and swelling capacity of a SAP varies depending on the degree of cross-linking within the polymer. The lower the density of the cross-linking the higher the absorbent capacity of the SAP. Thus, low density cross-linked SAP's generally have a higher absorbent capacity and swell to a larger degree than more highly cross-linked SAP's. Low density cross-linked SAP's also have a softer and more cohesive gel formation. High cross-link density polymers exhibit lower absorbent capacity and swell. The gel strength is firmer and can maintain particle shape even under higher pressures.

Consequently, by using a SAP with a higher cross-link density, a soft-projectile can be made to fly farther and faster without breaking apart and have a stronger impact. In contrast, soft-projectiles made from a SAP with a lower cross-link density will break apart more easily and have a much softer impact. Depending on the level of safety required, different SAP's with different cross-link densities may be used. For example, SAP's can be constructed that would be considered "highly compliant" by industry standards.

Soft-projectiles made from a SAP are preferably round but may be of other shapes as well, including, for example, dart shapes, cylinder shapes, bullet shapes, oval, square, rectangular or any other shape. Round is a preferable shape not only because it has fairly good ballistic characteristics but because SAP's are easily formed in round shapes.

Soft-projectiles made from a SAP can be any size. Preferably, however, the soft-projectiles made from a SAP are between about 3 millimeters (mm) and about 15 mm in diameter when hydrated and more preferably between about 5 mm and 8 mm in diameter when hydrated. Typically, the soft-projectiles are about 1 mm or less when the SAP forming the projectile is dehydrated.

Larger soft-projectiles made from a SAP are possible. For example, rounds having a diameter of 30 mm have been created. However, there is approximately a 20% tolerance on the final diameter of the hydrated SAP soft-projectiles and therefore, the larger rounds are more difficult to make consistently uniform in diameter.

The SAP projectiles may be colorless to prevent any staining upon impact. Alternatively, soft-projectiles made from a SAP may also have additives added during the formulation of the SAP or during hydration that will create a temporary or indelible signature upon hitting a target. For example, soft-projectiles made from a SAP may be colored by adding a die to the SAP or the aqueous solution during the hydrating process. Depending on the die employed, the resulting signature may be of any desired color. Further, the employed die compound may be visible under normal lighting conditions or only under a ultra violet black light. Other additives may also be used including those that give the soft-projectiles a tracer effect such as glow-in-the-dark additives or other materials with luminescent properties.

Soft-projectiles made from water absorbing polymers, classified as hydrogels, will absorb aqueous solutions through hydrogen bonding with the water molecule. A SAP's ability to absorb water is a factor of the ionic concentration of an aqueous solution. Consequently, soft-projectiles made from a SAP are preferably grown in water with a PH of 7. More preferably soft-projectiles made from a SAP are grown in distilled water, where they may absorb 500 times their weight, and from 30-60 times their dehydrated volume.

FIG. 1 illustrates a cross section of one embodiment of a projection device 10, which in the present embodiment is a projectile launching toy, designed for use with soft-projectile 16. The soft-projectiles of the present patent document are formed from a super absorbent polymer. As shown in FIG. 1, projection device 10 is in the general form of a gun. However, in other embodiments, projection device 10 can have shapes and designs of other devices. For example, projection device 10 can be a bow, crossbow, sling shot, hand gun, machine gun, futuristic weapon, catapult, or shaped as any other type of weaponry. Projection device 10 can be made of a number of suitable materials including metals, rubbers and plastics; however, injection molded plastic is a preferred construction material.

Projection device 10 has a firing position 30. The firing position 30 is where the soft-projectile 16 is positioned just prior to being fired or launched from the projection device 10. The firing mechanism of the embodiment shown in FIG. 1 is based on air pressure, which is created in air compression chamber 31. However, the firing mechanism of the projection device 10 may be based on any of the known ways of firing or launching projectiles or ammunition from a projection device. For example, springs or rubber bands can be stretched and released to launch the projectile from the projection device 10. These springs or rubber bands may further use a mechanical advantage to increase the velocity of the projectile as it is launched. As an example, compounds bows use a system of levers or pulleys to make the transfer of energy from the spring of the bow to the projectile more efficient. In addition to springs and rubber bands, air pressure can be used, as in the embodiment illustrated in FIG. 1. Air pressure can be created in a number of ways including, for example, from a plunger operated by the user, from a cartridge containing compressed gas (such as the $CO_2$ cartridges used with paint ball guns), from air that has been pumped into an internal chamber and then released, or from an explosion in a chamber.

In addition, various techniques of launching a projectile may also be combined. For example, the embodiment shown in FIG. 1 uses the combination of a spring and air pressure. The components of FIG. 1 will now be further described with respect to the use of projection device 10 to launch a soft-projectile made from a SAP 16.

To begin the process of firing a soft-projectile 16 made from a SAP with the device shown in FIG. 1, a user pulls back on the handle 11 which retracts the plunger 12 out of the aft end 17 of a plunger cylinder 19. The plunger 12 is attached to spring 18. As the spring 18 is stretched, air is sucked into an air compression chamber 31 located between plunger seal 24 and air seal 22. Air seal 22 abuts against a stop (not shown) just behind the firing position 30 to prevent air seal 22 from following the plunger 12 past a certain point as it is drawn back. Consequently, the spring 18 is stretched. When the user releases the handle 12, the spring 18 quickly pulls the plunger 12 back inside the plunger cylinder 19. This creates a rapid increase in air pressure in the air compression chamber 31 between plunger seal 24 and air seal 22. Consequently, air seal 22 is propelled rapidly through barrel 15 towards the distal end of barrel 15 and simultaneously accelerates the holder for a soft-projectile 14 and the soft-projectile 16. The soft-projectile 16 is launched from the projection device 10 on a free trajectory and the air seal 22 and soft-projectile holder 14 are retained within the barrel 15 of projection device 10.

In the embodiment of the projection device 10 shown in FIG. 1, the air seal 22 and the soft-projectile holder 14 are retained via their connection to the spring 18. However, the soft-projectile holder 14 and air seal 22 may be retained by other means. For example, a stop (not shown) may be installed inside of barrel 15 to prevent air seal 22 or soft-projectile holder 14 from escaping but allow the soft-projectile 16 to pass freely. Preferably, the stop is located adjacent the barrel exit to maximize the distance over which the soft-projectile 16 is carried in the holder 14 before exiting the barrel.

Once the soft-projectile made from a SAP 16 has been launched, the plunger 12 and plunger seal 24 have been pulled inside the plunger cylinder 19 to the extent possible. In this position, the plunger seal 24 is located just behind the firing position 30. When the user wants to fire another round, the user pulls back on the handle 11. As the plunger 12 is retracted, air seal 22 and soft-projectile holder 14 are drawn behind the magazine or feed hopper 50. Once the air seal 22 and the soft-projectile holder 14 are positioned behind the magazine or feed hopper 50, another soft-projectile made from a SAP 16 can fall into the firing position 30.

Toy guns and weaponry are typically classified into two different categories: 1) devices that can transfer stored energy into the projectile; and 2) devices that are incapable of storing energy independent of the user. The projection device 10 embodied in FIG. 1 is of the latter type. However, the device in FIG. 1 could be easily modified to store energy. For example, a one way valve could be added in combination with a trigger mechanism to prevent air seal 22 and soft-projectile holder 14 from advancing. The plunger 12 could be used to pump additional pressure into the air compression chamber 31 behind air seal 22. The user would then pull the trigger to release the pressure that has built up from multiple pumps of the plunger 12.

Figure 2:
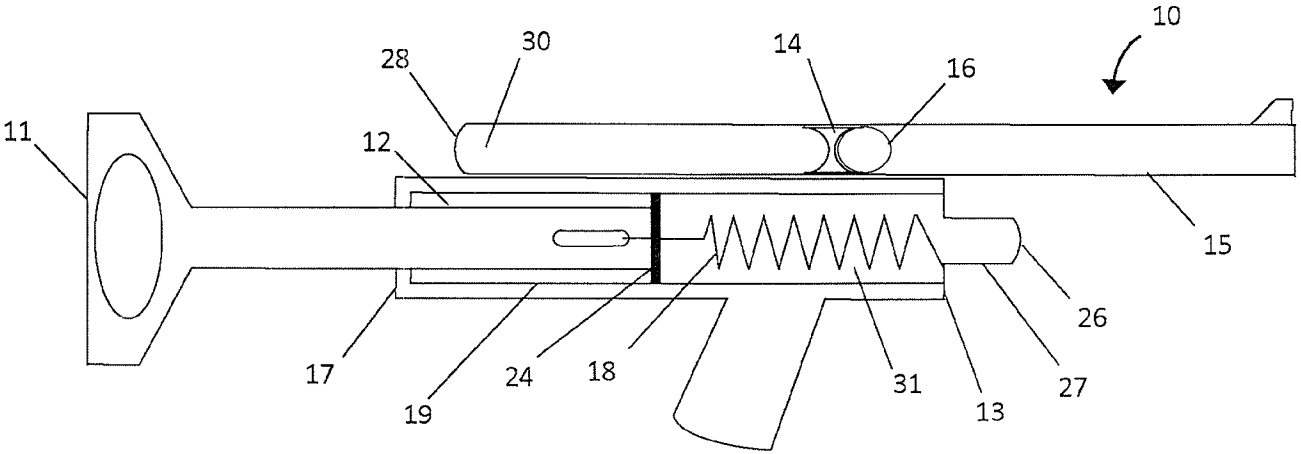
FIG. 2 illustrates a cross section of one embodiment of a projectile launching toy designed for use with a projectile made from a super absorbent polymer.

FIG. 2 illustrates a cross section of another embodiment of a projection device 10 designed for use with soft-projectiles 16 made from a super absorbent polymer. Projection device 10 of the present embodiment is a projectile launching toy. In the device 10 shown in FIG. 2, The smaller diameter tube 27 is wrapped back around to the back of the projection device 10 and laid on top of the projection device 10 so that tube portions 26 and 28 are continuously connected. In the embodiment in FIG. 2, the volume in front of plunger seal 24 transitions from plunger cylinder 19, which has a comparatively large diameter, to a tube 27, which has a smaller diameter than plunger cylinder 19. The change in the diameter of the air compression chamber 31 from the plunger cylinder 19, which comprises a tube of a relatively larger diameter, to a smaller diameter tube 27 will cause, during use of the device, a rapid increase in the velocity of the air flow in correlation with the conservation of energy and Bernoulli's principle. Consequently, the rapid air flow is forced down the length of the smaller tube 27 until it escapes out the front of the projection device 10. As the air rushes down the smaller diameter tube 27 the soft-projectile holder 14, which fits with an air seal inside the smaller diameter tube 27, is rapidly accelerated with the air, carrying the soft-projectile 16 made from a SAP and launching it out of the projection device 10.

Unlike the embodiment of FIG. 1, the soft-projectile holder 14 is not retained by the spring. In the embodiment of FIG. 2, the soft-projectile holder 14 is slideably contained by the barrel 15, but is not otherwise attached. The soft-projectile holder 14 acts as a free sliding piston that may operate independently of the plunger 12. A stop near the end of the barrel 15 and a stop near tube position 28 retains the soft-projectile holder 14 within a desired operating region of the barrel 15.

The stop near the end of the barrel 15 should be designed to retain the soft-projectile holder 14 without interfering with the launching of the soft-projectile 16 made from a SAP.

FIG. 2 illustrates a device 10 having a smaller tube 27 that wraps from a position relatively near the distal or front end 13 of plunger cylinder 19 back to a position relatively near the proximal or back end 17 of plunger cylinder 19 and then extends down the length of the plunger cylinder 19. This is not required and the smaller tube could simply extend straight away from distal end 13. However, by wrapping the tube as shown in FIG. 2, the more rigid structure of the plunger cylinder can be used to help stiffen the tube 27.

The soft-projectile holder 14 is preferably designed to minimize, or even prevent altogether, the contact of the soft-projectile 16 with the barrel 15 as the soft-projectile 16 travels down the barrel 15. Although soft-projectile holder 14 is not a requirement, minimizing the contact between the soft-projectile 16 and the barrel 15 is preferable. The soft-projectile 16 will tend to retain its shape, especially if the cross-link density is high. However, if the soft-projectile 16 is nicked, scratched, or damaged by the barrel as it accelerates, it may disintegrate prior to exiting the barrel 15, especially if the cross-link density is low. If the soft-projectile 16 disintegrates prior to exiting the barrel 15, the soft-projectile 16 will not fly accurately or the correct distance. Consequently, the design of the soft-projectile holder 14 should take care to encase enough of the soft-projectile 16 to prevent it from touching the sides of the barrel 15 as it travels. The soft-projectile holder 14 is preferably cup shaped in a form that mates with the exterior surface of the soft-projectiles 16 to be employed with the device. However, the soft-projectile holder 14 may be bucket shaped, crescent shape, or any other shape that helps prevent or suitably minimize the contact between the soft-projectile 16 and the barrel 15.

In addition to preventing contact between the soft-projectile 16 and the barrel 15 during launch, the soft-projectile holder 14 also helps transfer the energy of the firing mechanism into the motion of the soft-projectile 16. In addition, if shaped similar to soft-projectile 16, the soft-projectile holder 14 helps distribute the force generated by the firing mechanism evenly over the soft-projectile 16 and therefore, helps prevent the soft-projectile 16 from breaking during launch. Consequently, a holder 14 that mates more appropriately with the shape of the outside surface of the soft-projectile 16 is preferable. Furthermore, the soft-projectile holder 14 may help center the soft-projectile 16 and keep the soft-projectile 16 centered as it travels down the barrel 15. To this end, a soft-projectile holder 14 in the shape of a hemisphere may be used with round soft-projectiles 16. The hemispherically shaped holder 14 may have a diameter slightly larger than the soft-projectile 16 to not only help prevent contact with the interior of the barrel 15, but also to accommodate variations the diameters of soft-projectiles 16.

Although the embodiments of FIGS. 1 and 2 illustrate a device 10 using a spring and air pressure, and preferably a combination of a spring and air pressure is used, projection device 10 can use a catapult system, sling shot, bow style or any other type of acceleration system to launch the soft-projectile 16. As another example, projection device 10 can accelerate the soft-projectile or soft-projectile holder by an accelerating mass, like the hammer of a gun, impacting the soft-projectile or soft-projectile holder. Furthermore, these devices can all be set up to work with stored energy or work with only energy provided by a user without departing from the embodiments of the present patent document.

Figure 3:
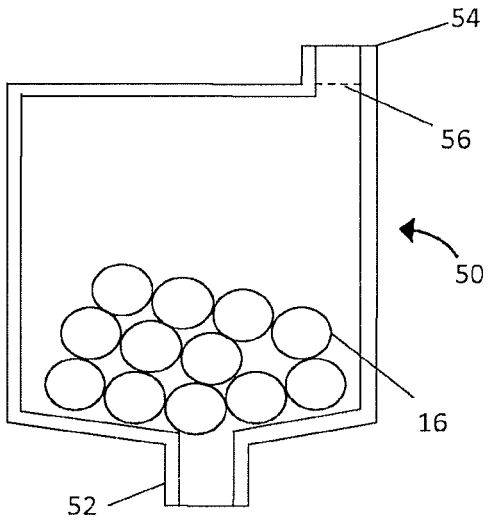
FIG. 3 illustrates a cross section of a projectile magazine for use with a projectile launching toy such as that shown in FIG. 1.

FIG. 3 illustrates a cross section of a magazine 50 for use with a projectile device 10, such as the projectile launching toy shown in FIG. 1. Magazine 50 can be of any shape or size and is intended to contain the soft-projectiles 16 made from a SAP. Magazine 50 can be made of metal, glass, plastic, rubber, or any other suitable material. Preferably magazine 50 is constructed of injected molded plastic. Magazine 50 may be reusable and refillable or designed for a single use and disposable. Magazine 50 can be loaded with already hydrated soft-projectiles 16 made from a SAP. Alternatively, magazine 50 can be loaded with dehydrated soft-projectiles 16 made from a SAP. If dehydrated soft-projectiles are used, water or another aqueous solution is added to the magazine 50 to hydrate the soft-projectiles 16 made from a SAP. Magazine 50 is preferably sealable to prevent water or moisture from the soft-projectiles 16 from leaking out.

Magazine 50 has a first opening 52 designed to mate with a projection device 10. Preferably the first opening 52 of magazine 50 includes a locking mechanism, such as a trap door, that prevents the first opening from opening when the magazine 50 is not mated to a corresponding projection device 10. The locking mechanism provides a safety mechanism that prevents foreign objects from being loaded into the magazine 50 and launched by the projection device 10. The locking mechanism can be a keying system, child safety device, or other locking mechanism that prevents foreign objects from being loaded into the magazine.

The opening on the projection device 10 that mates with the magazine preferably has a corresponding locking mechanism to complement the locking mechanism on the magazine 50. Consequently, soft-projectiles 16 may only be loaded into the projection device 10 from the magazine 50. Similar to the locking mechanism that prevents foreign objects being loaded into the magazine 50, the corresponding locking mechanism on the opening in the projection device prevents foreign objects from being loaded directly into the projection device 10 and then launched.

As shown in FIG. 3, the magazine 50 may have a second opening 54 for refilling the magazine with soft-projectiles 16 made from a SAP into the magazine. The second opening 54 may be large enough to allow hydrated soft-projectiles 16 to be loaded directly into the magazine. In such a case, the interface between the magazine 50 and the projection device 10 should be designed to prevent foreign objects from being loaded from the magazine 50 into the projection device 10 and subsequently launched.

Alternatively, the second opening 54 may further include a screen 56 designed to prevent passage of objects larger than a particular size. The dehydrated SAP pieces forming the soft-projectiles 16 may typically have a diameter of about 1 millimeter (mm) or less. In such embodiments, the screen 56 can be designed to only allow objects of approximately 1 mm or less in diameter to pass through. The dehydrated soft-projectiles 16 can then be loaded into the magazine 50 and water or another aqueous solution can be added and the soft-projectiles 16 can swell to their appropriate size. The screen 56 is a safety mechanism to make sure foreign objects are not loaded into the magazine 50 and then subsequently launched from the projection device 10. Although it is recognized that foreign objects of less than 1 mm can be loaded into the magazine, objects of less than 1 mm are much less likely to cause significant damage if subsequently launched by the projection device 10 because of their reduced size and weight.

The dehydrated soft-projectiles 16 may be sold in a kit designed to refill a magazine 50. In one embodiment, the kit comprises a pre-counted number of dehydrated rounds designed to fill up a particular magazine when hydrated. A magazine 50 preferably holds between 150 and 250 rounds and more preferably holds about 200 soft-projectiles 16.

However, the magazine 50 and the kit that fills the magazine 50, can hold any number of soft-projectiles. For example, larger clips of approximately 500 to 1000 rounds may be used for machine guns, Gatling guns, or other rapid fire projection devices 10. In contrast, magazines or clips of 6 to 20 rounds may be used for single shot toys and weaponry.

The kit preferably further includes instructions on how to insert the dehydrated rounds into the magazine 50 and grow the dehydrated rounds inside the magazine 50. After purchasing a kit, a user would dump the dehydrated rounds into the magazine and follow the directions to add distilled water or another appropriate aqueous solution to hydrate the rounds and swell them into their appropriate size for launching from a projectile device 10.

In addition to projection devices designed specifically to launch soft-projectiles 16, embodiments of the present patent document include adaption devices to adapt existing projectile toys and weaponry to launch soft-projectiles 16. Adaption devices attach to the firing mechanism of the existing toy or weaponry and allow the transfer of energy from the firing mechanism into kinetic motion of the SAP projectile 16 without damaging the SAP projectile 16. Preferably, soft-projectile holders 14, similar to those of FIGS. 1 and 2, are retrofit to the existing toys and/or weaponry to protect the soft-projectile made from a SAP 16. However, such holders are not required, and other methods may be used without departing from the scope of the embodiments of the present patent document.

Although the inventions have been described with reference to preferred embodiments and specific examples, it will readily be appreciated by those skilled in the art that many modifications and adaptations of the methods and devices described herein are possible without departure from the spirit and scope of the inventions as claimed hereinafter. Thus, it is to be clearly understood that this description is made only by way of example and not as a limitation on the scope of the inventions as claimed below.

What is claimed is:

1. A projectile launching system, comprising: ammunition comprising a plurality of substantially spherical soft-projectiles formed from hydrated super absorbent polymer; and a projectile launcher for launching the ammunition in free flight.

2. The system of claim 1, further comprising a sealed container for storage of the ammunition.

3. The system of claim 1, wherein the projectile launcher is a toy.

4. The system of claim 1, wherein the projectile launcher is in the shape of a gun.

5. The system of claim 1, wherein the projectile launcher includes a feed chamber for loading the soft-projectiles within projectile launcher.

6. The system of claim 5, wherein the feed chamber is provided within a magazine.

7. The system of claim 5, wherein the projectile launcher is adapted to load the soft-projectiles

8. The system of claim 7, wherein the projectile launcher further comprises:

an air compression chamber;

a piston disposed within and axially aligned with the air compression chamber; and a spring operatively arranged to bias the piston toward a rest position from a cocked position within the air compression chamber.

9. The projectile system of claim 8, wherein the projectile launcher further comprises a smaller diameter tube in communication with the air compression chamber, and wherein a biasing force of the spring is sufficient to cause the piston to move from the cocked position to the rest position to force air from the air compression chamber into the smaller diameter tube and cause a soft-projectile located at the firing position to accelerate and be launched from the projectile launcher. from the feed chamber to a firing position of the projectile launcher.

10. The system of claim 1, wherein the super absorbent polymer has a cross linking density sufficient to prevent the soft-projectiles from breaking apart when launched from the projectile launcher.

11. The system of claim 1, wherein the projectile launcher is designed to use air pressure to launch the soft-projectiles.

12. The system of claim 1, wherein the projectile launcher comprises a firing mechanism that stores energy independent of a user.

13. The system of claim 1, wherein the projectile launcher comprises a firing mechanism that is incapable of storing energy independent of a user.

14. The system of claim 1, wherein the projectile launcher comprises a firing mechanism that directly applies a force to the ammunition.

15. The system of claim 1, wherein the projectile launcher comprises a firing mechanism that indirectly applies a force to the ammunition.

* * * * *